US008550971B2

(12) United States Patent
Chan et al.

(10) Patent No.: US 8,550,971 B2
(45) Date of Patent: Oct. 8, 2013

(54) SYSTEMS FOR PRODUCING CUSHIONING MATERIAL

(75) Inventors: Simon C. S. Chan, Kirkland, WA (US); Shek Wah Hau, Kowloon (CN)

(73) Assignee: Nuevopak Technology Company Limited, Kwun Tong, Kowloon (HK)

( * ) Notice: Subject to any disclaimer, the term of this patent is extended or adjusted under 35 U.S.C. 154(b) by 0 days.

(21) Appl. No.: 13/527,548

(22) Filed: Jun. 19, 2012

(65) Prior Publication Data

US 2012/0322644 A1 Dec. 20, 2012

Related U.S. Application Data

(63) Continuation of application No. 12/101,829, filed on Apr. 11, 2008, now abandoned.

(51) Int. Cl.
*B31B 1/00* (2006.01)

(52) U.S. Cl.
USPC ..... 493/464; 493/350; 493/407; 493/967

(58) Field of Classification Search
USPC ..... 493/464, 350, 407, 967
See application file for complete search history.

(56) References Cited

U.S. PATENT DOCUMENTS

| | | | |
|---|---|---|---|
| 3,509,797 | A | 5/1970 | Johnson |
| 4,619,635 | A | 10/1986 | Ottaviano |
| 5,188,581 | A | 2/1993 | Baldacci |
| 5,439,730 | A | 8/1995 | Kelly et al. |
| 5,571,067 | A | 11/1996 | Ratzel |
| 5,593,376 | A | 1/1997 | Armington |
| 5,730,696 | A | 3/1998 | Simmons |
| 5,749,539 | A | 5/1998 | Ratzel |
| 5,785,639 | A | 7/1998 | Simmons |
| 5,836,538 | A | 11/1998 | Lencoski |
| 5,871,429 | A | 2/1999 | Harding |
| 5,876,318 | A | 3/1999 | Ratzel |
| 5,891,010 | A | 4/1999 | Kobben |
| 5,947,886 | A | 9/1999 | Simmons |
| 6,015,374 | A | 1/2000 | Murphy |
| 6,026,632 | A | 2/2000 | Simmons |
| 6,033,353 | A | 3/2000 | Lencoski |
| 6,055,795 | A | 5/2000 | Harding |
| 6,077,209 | A | 6/2000 | Armington |
| 6,095,454 | A | 8/2000 | Simmons, Jr. |
| 6,179,762 | B1 | 1/2001 | Harding |
| 6,203,481 | B1 | 3/2001 | Harding |
| 6,207,249 | B1 | 3/2001 | Lencoski |
| 6,210,310 | B1 | 4/2001 | Manley |

(Continued)

FOREIGN PATENT DOCUMENTS

| | | | |
|---|---|---|---|
| AU | 2005304676 | A1 | 5/2006 |
| CA | 2586540 | A1 | 5/2006 |

(Continued)

*Primary Examiner* — Hermant M Desai
(74) *Attorney, Agent, or Firm* — DWC Law Firm, P.S.; David Chen

(57) ABSTRACT

Methods, apparatus and systems for producing cushioning material from sheet material. In some embodiments, the apparatus comprises horizontally aligned forming members having fins for use in pulling and processing sheet material. The sheet material can be perforated sheet material. A holder can be provided for holding sheet material in stock roll form, the holder having a cross-bar for producing resistance against the stock roll to dissipate momentum of the stock roll when the motor of the apparatus is stopped.

10 Claims, 11 Drawing Sheets

(56) References Cited

U.S. PATENT DOCUMENTS

| | | | | |
|---|---|---|---|---|
| 6,402,674 | B1 | 6/2002 | Simmons | |
| 6,610,001 | B1 | 8/2003 | Harding | |
| 6,699,167 | B2 | 3/2004 | Manley | |
| 6,877,297 | B2 | 4/2005 | Armington | |
| 6,910,997 | B1 | 6/2005 | Yampolsky | |
| 6,918,489 | B2 | 7/2005 | Harding | |
| 6,974,407 | B2 | 12/2005 | Ratzel et al. | |
| 7,044,903 | B2 | 5/2006 | Simmons, Jr. | |
| 7,083,560 | B2 | 8/2006 | Kobben | |
| 7,125,375 | B2 | 10/2006 | Kung | |
| 7,186,208 | B2 | 3/2007 | Demers | |
| 7,195,585 | B2 | 3/2007 | Harding | |
| 7,407,471 | B2 | 8/2008 | Demers et al. | |
| 7,651,455 | B2 | 1/2010 | Yampolsky et al. | |
| 7,803,100 | B2 * | 9/2010 | Lu et al. | 493/464 |
| 2002/0082152 | A1 * | 6/2002 | Manley | 493/464 |
| 2003/0040416 | A1 | 2/2003 | Lucassen et al. | |
| 2003/0073558 | A1 | 4/2003 | Chesterson et al. | |
| 2007/0066472 | A1 | 3/2007 | Harding et al. | |
| 2007/0117703 | A1 | 5/2007 | Cavaliere et al. | |
| 2008/0066630 | A1 | 3/2008 | Siu et al. | |
| 2008/0098699 | A1 * | 5/2008 | Cheich et al. | 53/472 |
| 2008/0125301 | A1 * | 5/2008 | Manley | 493/464 |
| 2008/0153685 | A1 * | 6/2008 | Cheich et al. | 493/381 |
| 2008/0207421 | A1 | 8/2008 | Wetsch et al. | |
| 2009/0082187 | A1 | 3/2009 | Cheich et al. | |

FOREIGN PATENT DOCUMENTS

| | | | |
|---|---|---|---|
| EP | 1814787 | A2 | 8/2007 |
| JP | 2008518859 | T | 6/2008 |
| KR | 20070087584 | A | 8/2007 |
| WO | 2006052980 | A3 | 5/2006 |

* cited by examiner

SYSTEMS FOR PRODUCING CUSHIONING MATERIAL

CROSS-REFERENCE TO RELATED APPLICATION

This application is a continuation of U.S. Utility patent application Ser. No. 12/101,829, filed Apr. 11, 2008, now abandoned, which is incorporated herein by reference in its entirety.

BACKGROUND

1. Field of the Disclosure

The present disclosure relates to apparatus, systems, and methods for producing materials used to fill voids in containers and packages.

2. Description of Related Art

Flexible sheet material is often used to produce cushioning material for use in containers and packages, such as boxes and cargo containers (hereinafter collectively called "containers"), for protecting or cushioning products stored therein. The sheet material is often provided in substantially planar form, and can be fed into a machine that processes the sheet material to form it into a cushioning material. The cushioning material can be a non-uniform, non-planar expanded structure of the sheet material. The cushioning material is expanded from its original structural form, in the sense that it occupies a larger volume than the planar sheet material. The cushioning material can have resiliency and load bearing strength in its expanded form. Cushioning material of this type is often referred to as "dunnage" in the relevant field.

A typical machine and process for creating the cushioning material can involve using a stock roll of sheet material, such as, for instance, kraft paper in rolled form. The sheet material can comprise multiple layers, with the multiple layers strengthening the resulting cushioning material. The sheet material can then be fed directly from the roll into forming members to crumple the sheet material and generate cushioning material.

It has been observed by the inventors hereof that various dunnage machines available on the market are large and burdensome to handle and many suffer from impaired efficiency due to design.

Also, it is noted that "kraft" paper is the most widely used base material for making crumpled cushion material for in-the-box packaging applications. For different packaging needs, paper of different base weights are used to provide different degrees of cushioning effect. Generally, light loading needs lighter paper and vice versa. 50 to 100 GSM Kraft paper in roll form is the normal weight range acceptable as industry standard. Many of the cushioning paper conversion machines (or dunnage machines) available on the market presently are designed for use with Kraft papers. Papers other than the Kraft paper usually cannot stand the very demanding strength exerted on the paper while being pulled through the most dunnage machines. However, presently, companies using cushioning material are requesting more variety in cushioning material to meet different diverse demands.

Finally, is it noted that dunnage machines comprising manually operated cutters or automated cutters can sometimes be dangerous to the operator or can cause fatigue.

BRIEF SUMMARY

In some embodiments of the present disclosure, a system is provided for use in producing cushioning material. The system can comprise a motor that drives a plurality of forming members. Each of the forming members has fins for use in crumpling sheet material and pulling the sheet material through the system to form cushioning material.

As the forming members pull the sheet material from a feed system, the sheet material can pass through a funnel-like passageway with converging sidewalls. In some embodiments, the sheet material is fed to the system from a horizontally disposed roll of sheet material, so the sheet material is laterally folded, rolled or compressed as it passes through the funnel-like passageway to decrease a horizontal width of the sheet material.

After being laterally folded, the sheet material is vertically compressed or crumpled by passing between the horizontally aligned forming members, as the fins of the forming members impact the sheet material from above and below the sheet material as it is fed through the system to produce the cushioning product.

In some embodiments, the stock sheet material is provided in rolled form, and the roll is held in a holder having a downwardly slanted edge-surface. An outer sheet portion of the roll abuts against a resting surface that creates resistance against an unwinding of the roll. The resistance can help dissipate momentum of the roll when sheet material is being fed through the system and the motor of the system is stopped. This can help prevent unwanted feed of sheet material from the roll into the machine portion of the system.

In some embodiments of the present disclosure, a dunnage machine is provided having speed selection member mapped to a plurality of indicia for use in selecting motor speed. The indicia can represent different types of paper, such that user can select a paper type thereby adjusting speed of the motor.

In still further embodiments of the present disclosure, perforated stock sheet material is provided, with the perforated stock sheet material having a perforation structure to avoid tearing of the stock sheet material during processing, but to allow a user to easily tear sections of dunnage away at the perforations as needed.

DETAILED DESCRIPTION

In the following description, certain specific details are set forth in order to provide a thorough understanding of various embodiments of the disclosure. However, upon reviewing this disclosure one skilled in the art will understand that the disclosure may be practiced without many of these details. In other instances, well-known or widely available machine parts (such as, for example, drive-belts and gears), hardware, and embedded software have not been described in detail to avoid unnecessarily obscuring the descriptions of the embodiments of the present disclosure.

Various embodiments of the present disclosure are described for purposes of illustration, in the context of use with paper-based sheet materials for dunnage formation. However, as those skilled in the art will appreciate upon reviewing this disclosure, other materials may also be suitable.

Figure 1:
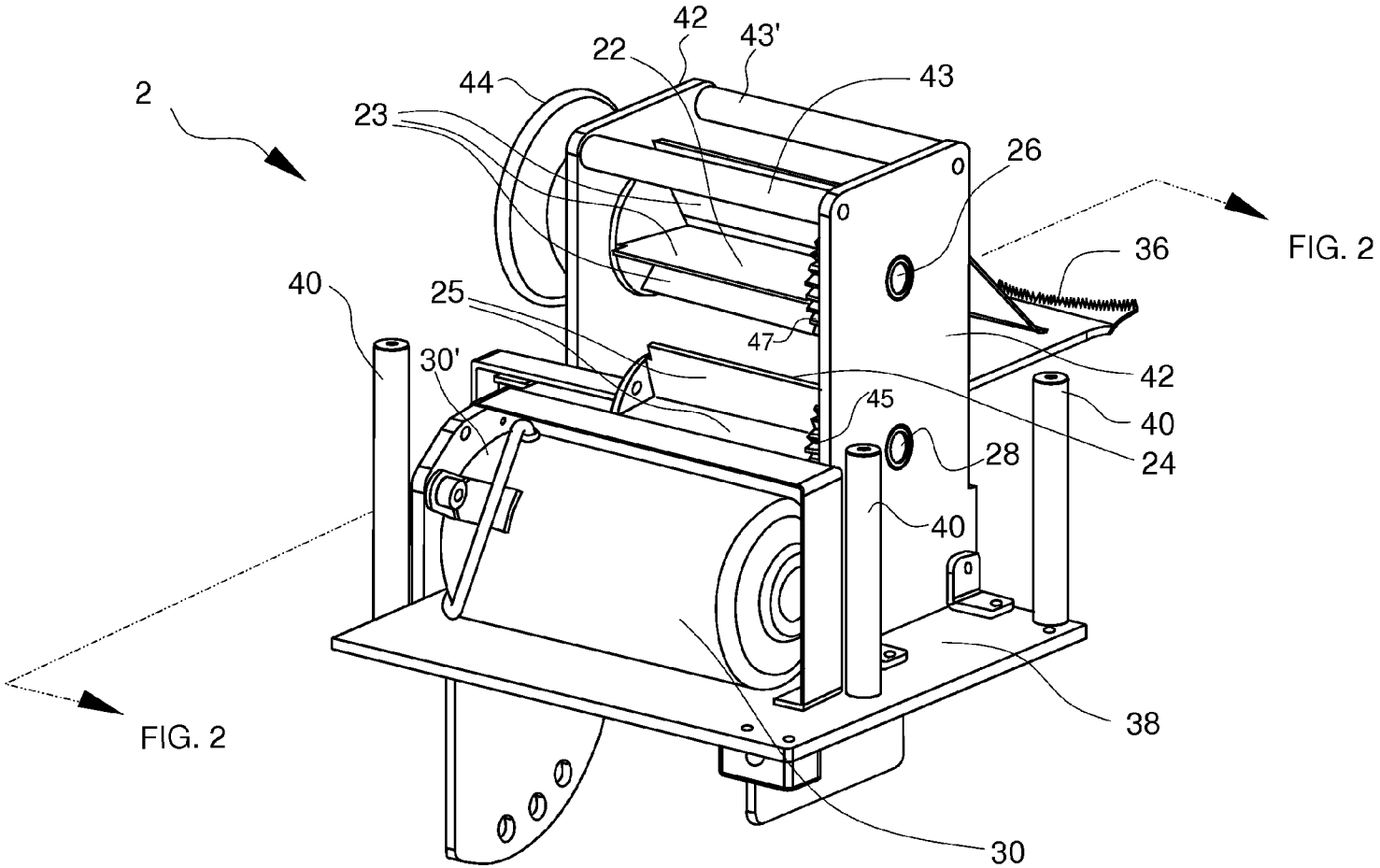
FIG. 1 is a perspective view of an embodiment of the dunnage machine of the present disclosure, without showing an external case of the dunnage machine.

Referring to FIG. 1, in some embodiments of the present disclosure, a dunnage machine 2 is provided having an upper forming member 22, and a lower forming member 24, the forming members being horizontally axially aligned. The forming members 22, 24 each have a plurality of fins, or fin members, 23, 25. Additionally, a base plate 38 can be provided having mounting plates 42 attached thereto. The mounting plates 42 can be fixedly attached to the base plate 38 and extend in substantially vertical fashion upward from the base plate 38. The upper and lower forming members 22, 24 can be rotatably attached to the mounting plates 42.

Figure 2:
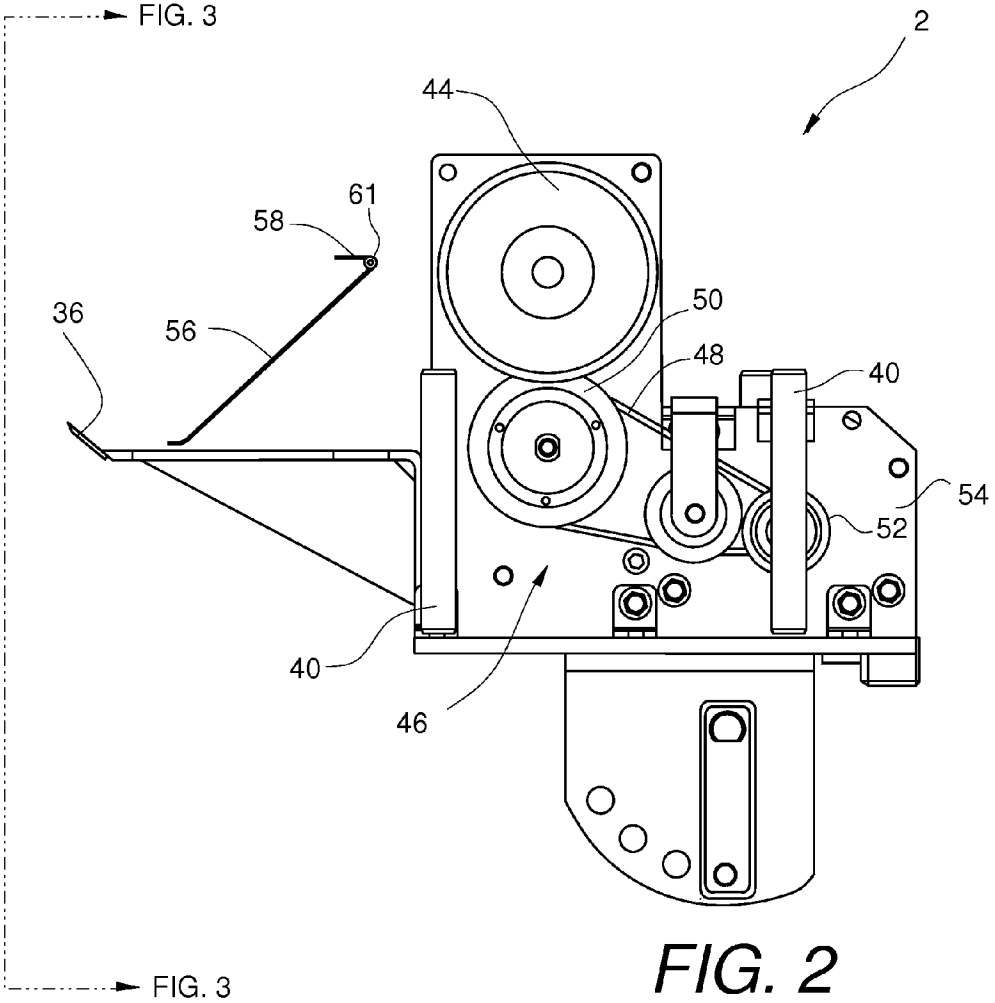
FIG. 2 is a side elevation view of the dunnage machine of FIG. 1, as viewed from line FIG. 2-FIG. 2 of FIG. 1.
Figure 3:
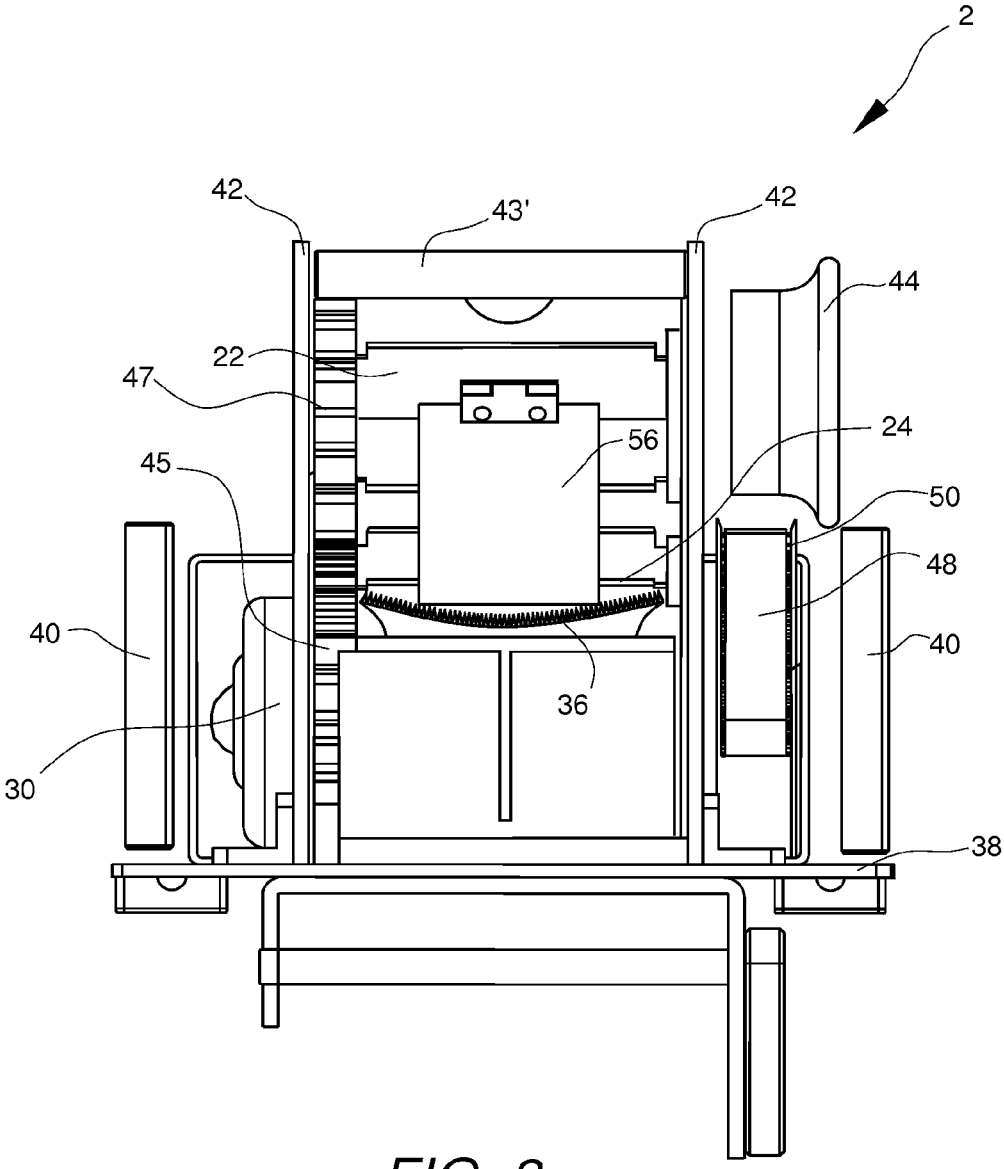
FIG. 3 is front elevation view of the dunnage machine of FIG. 2, as viewed from line FIG. 3-FIG. 3 of FIG. 2.
Figure 6:
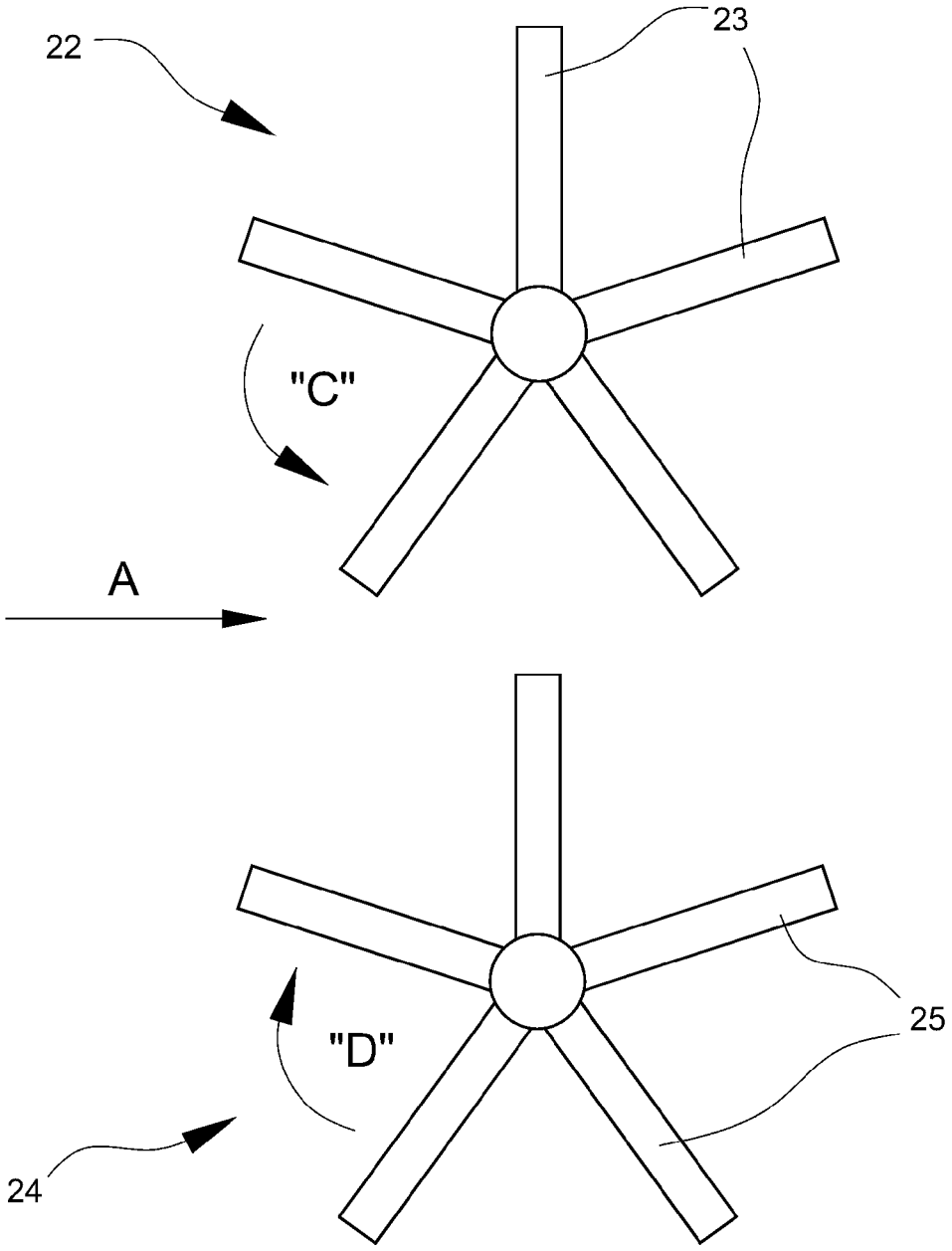
FIG. 6 is a simplified diagram showing interaction between the fins of forming members during rotation in some embodiments of the dunnage machine of the present disclosure.

Still referring to FIG. 1, in some embodiments of the present disclosure, a motor 30 is aligned in parallel fashion with the upper and lower forming members 22, 24. As best seen in FIG. 2, a drive wheel 52 is connected to a drive shaft (not illustrated). A drive belt 48, or timing belt, is frictionally coupled to the drive wheel 52 and a receiving wheel 50. Referring to FIG. 3, the receiving wheel 50 is rotatably mounted to the mounting plate 42, via a translation shaft that is also fixedly connected to the lower forming member 24 on an end portion of the lower forming member 24. Additionally, the lower forming member 24 is connected to a first lower gear 45 at an opposite end portion of the lower forming member 24. The first lower gear 45 is rotatable and movably mated with a first upper gear 47. The first upper gear 47 is attached to the upper forming member 22. Thus, as will be understood by those skilled in the art after reviewing this disclosure, when the motor 30 causes the drive wheel 52 to rotate, the receiving wheel 50 drives the lower forming member 24, which in turn drives the upper forming member 22 via interaction between the first lower gear 45 and first upper gear 47. As a result, the forming members 22, 24 rotate (as illustrated in FIG. 6) when the motor operates. Furthermore, in some embodiments of the present disclosure, the lower forming member 24 can be connected to a second lower gear (not illustrated) on an opposite end portion of the forming member 24 from the first lower gear 45, and the upper forming member 22 can be connected to a second upper gear (not illustrated) on an opposite end portion of the forming member from the first upper gear 47. The second upper gear and second lower gear can interact in substantially the same manner as the first upper gear and first lower gear. The presence of the second set of gears can assist in offsetting undesirable torque on the forming members 22, 24 during operation.

As illustrated in FIG. 1 and the simplified diagram of FIG. 6, the lower forming member 24 can have fin members 25, and the upper forming member 22 can have fin members 23. The forming members 22, 24 can be positioned such that the respective fin members do not overlap during rotation. When sheet material is fed to the forming members 22, 24 in the direction of arrow "A," and the dunnage machine is operated causing the forming members to rotate in the directions illustrated, the forming members interactively process the sheet material to crumple it and to pull the sheet material in direction "A" to feed it through the dunnage machine 2. That is, the fin members 23, 25 can perform the functions of forming and pulling the sheet material through the dunnage machine for continuous processing.

Figure 5:
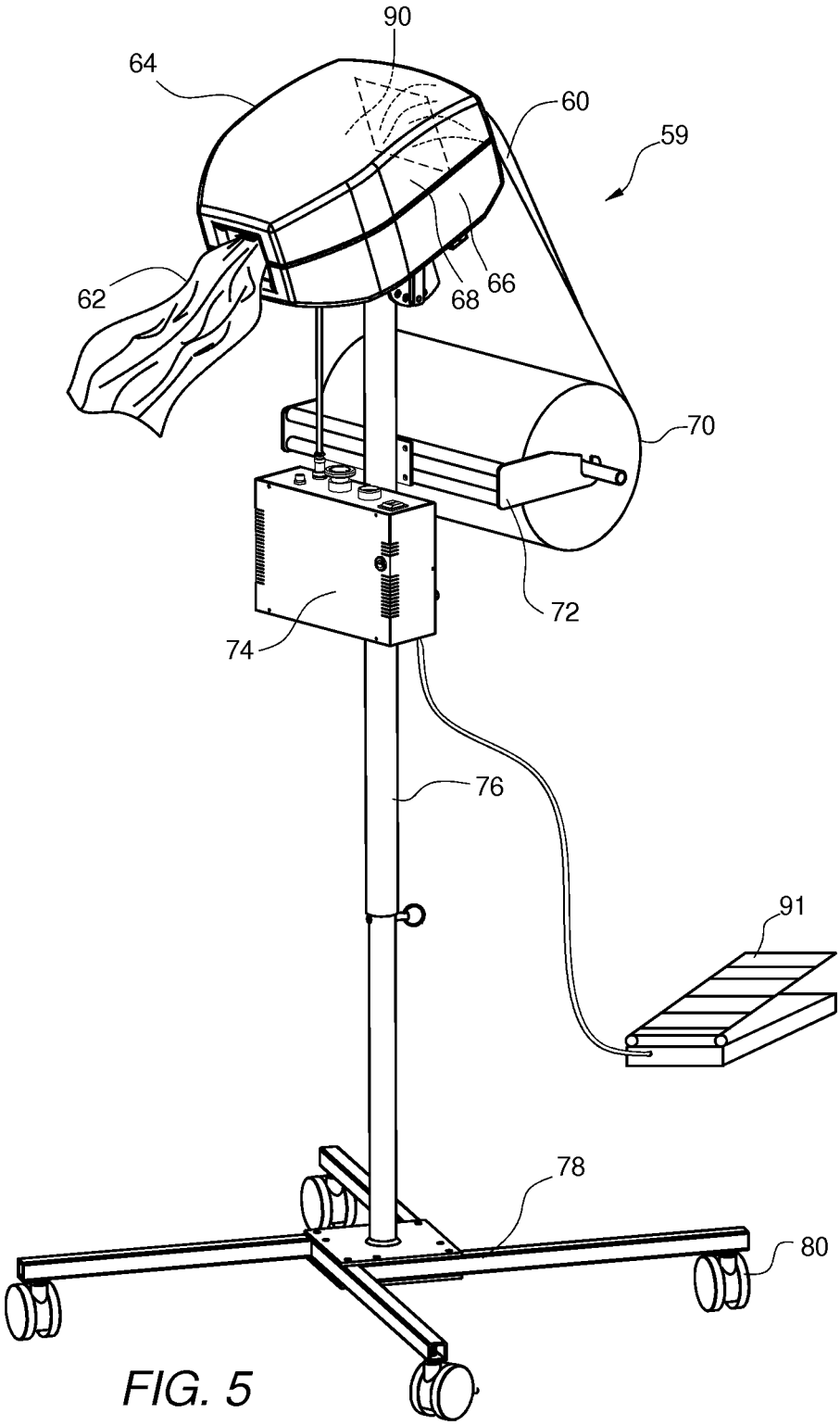
FIG. 5 is a perspective view of an embodiment of a dunnage preparation system of the present disclosure.

Referring now to FIG. 5, which shows an embodiment of a dunnage system 59 of the present disclosure, including the dunnage machine enclosed in an external case 64, sheet material 60 of a given width can be fed to the dunnage machine 2 from a stock roll 70 mounted upstream from an entrance opening 90 of the external case 64. The stock roll 70 can be rotatably mounted on a bracket 72. The bracket 72 is in turn connected to a support rack 76. Sheet material 60 can be pulled from the stock roll 70 by the forming members 22, 24 to the entrance 90 of the external case 64.

Figure 4A:
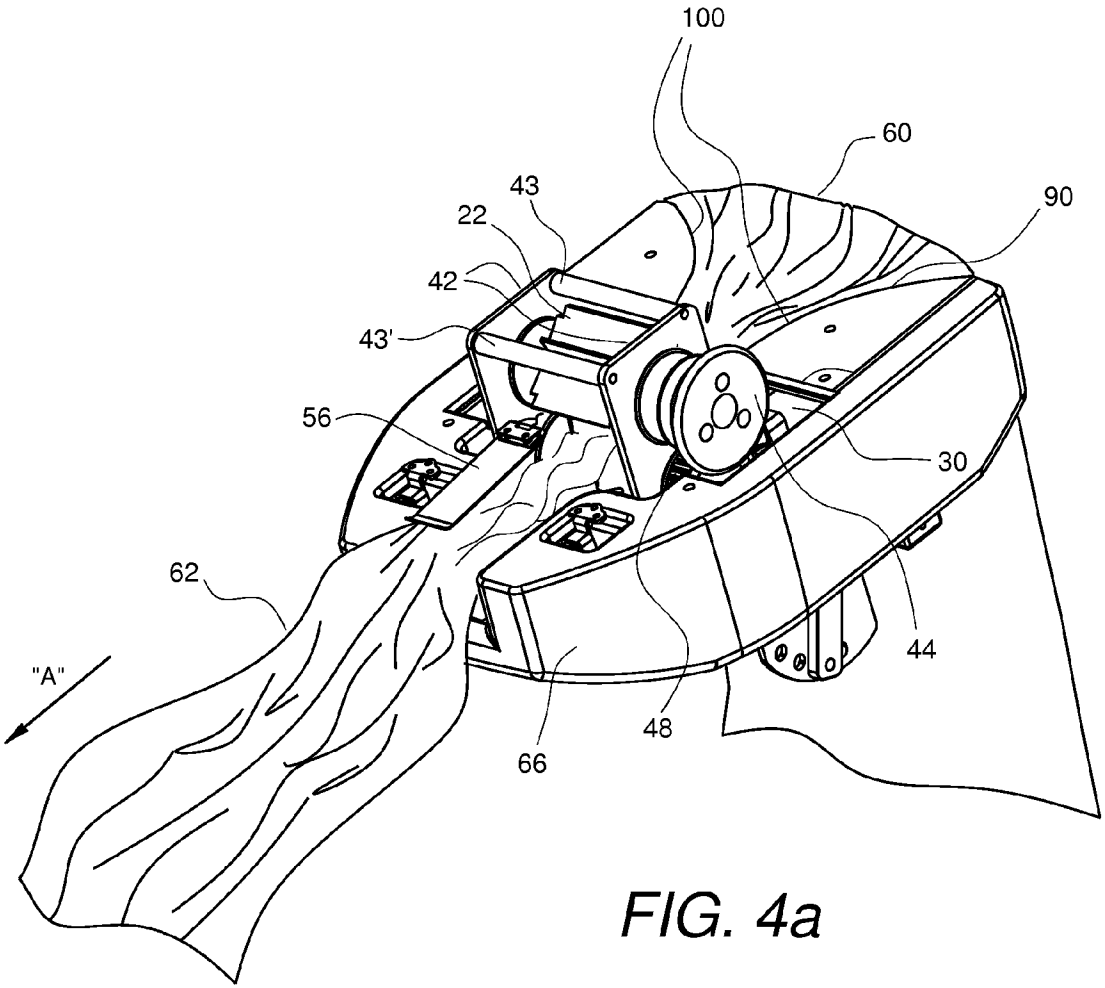
FIG. 4*a* is a perspective view of the dunnage machine of FIG. 1, showing a bottom portion of an example external case of the dunnage machine of the present disclosure.
Figure 4B:
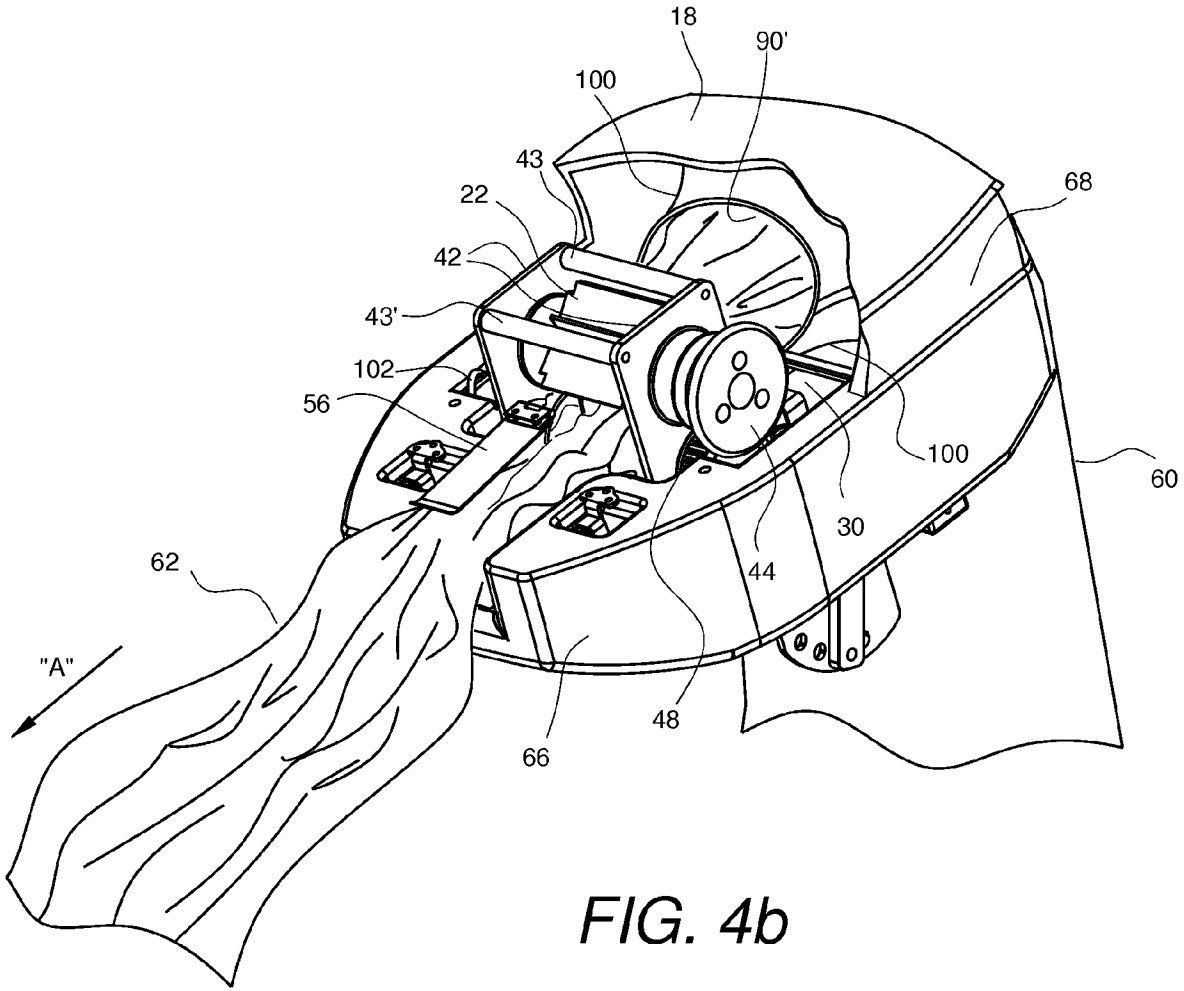
FIG. 4*b* is a perspective view of the dunnage machine of FIG. 4*a*, showing a cutaway section for the external case of the dunnage machine of the present disclosure, wherein an upper portion of the external case is also shown with the bottom and upper portion of the case together forming a funnel-like entrance opening.

As shown in FIGS. 4*a* & 4*b*, the bottom case portion 66 and upper case portion 68 are formed in a manner to provide funnel-like inner wall 100 leading to the forming members 22, 24. That is, for example, the external case 64 has a passageway 90' defined by internal sidewalls 100 that converge as the sidewalls approach the forming members 22, 24, such that the funnel-like passageway 90' is widest at the entrance to the external case 64 at opening 90, and most narrow just prior to the forming members 22, 24. As best seen in FIG. 4*a*, the funnel-like passageway with internal sidewalls 100 can assist in pre-forming the sheet material prior to entrance into the forming members 22, 24, by causing the edges of the sheet material to fold or crumple inward before reaching the forming members 22, 24. This folding or crumpling is mainly lateral as the sides of the sheet material 60 are brought inward toward the center of the sheet material, and as such, the vertical dimension of the sheet material increases as the sheet material is no longer flat.

Furthermore, it is noted that after the sheet material 60 is crumpled laterally inward as it is pulled through the passageway 90', by forming members 22, 24, it is then vertically compressed by the forming members 22, 24, which are horizontally aligned. That is, compression in the forming members 22, 24 is substantially ninety (90) degrees to compression in the funnel-like opening. As such, sheet material 60 is compressed twice, each time from a different direction (e.g., horizontally, then vertically). Without being bound by theory, the arrangement of the forming members 22, 24 in a horizontal configuration combined with the passageway 90', can result in compression of the sheet material both horizontally and vertically, to produce denser cushioning material when compared with various other dunnage machines available on the market that have vertically aligned forming members (i.e., forming members that rotate about vertical axes rather than horizontal axes). Indeed, the testing conducted by the inventors hereof has shown that the use of horizontal forming members produces cushioning material having higher load bearing capacity. That is, cushioning material produced using vertically aligned forming members deforms more easily than cushioning material produced using horizontally aligned forming members.

Still referring to FIGS. 4*a*-4*b*, after exiting the forming members 22, 24, the sheet material is effectively finished in its processing to cushioning material 62, and the cushioning material 62 passes through a freely swinging safety gate 56 in the direction of arrow "A". The freely swinging safety gate 56 has an upper portion that is pivotably connected to the upper case portion 68 of the external case 64, with the gate 56 hanging downward therefrom. As the cushioning material 62 exits the forming members 22, 24, it abuts against, and pushes, the safety gate 56 open to exit the case 64, in the direction of arrow "A." The safety gate 56 drops to a closed position when no cushioning material 62 is being processed.

Now turning to FIG. 2, in some embodiments of the present disclosure, a user of the dunnage machine 2 can selectively operate, then stop, the motor of the dunnage machine 2 and pull a section of the cushioning material 62 downward against a blade 36 disposed near the exit gate 56, to cut a section of cushioning material 62 away from the dunnage machine 2 to be used in a container for filling packing voids.

As best seen in FIG. 5, in some embodiments of the present disclosure, the dunnage system 59 is provided with a motor control center 74, having various actuating members for operating the dunnage system. For example, switches can be provided at the motor control center for power up, motor start and motor stop. In some embodiments, a motor kill switch can also be provided in conjunction with a reset switch for safety purposes. Furthermore, a control pedal 91 can also be provided to assist a user in ease of operation. The control pedal 91 can be configured such that when a user steps on the control pedal 91, the motor rotates, and when the user releases the control pedal 91, the motor stops.

Referring back to FIGS. 4*a* & 4*b*, in some embodiments of the present disclosure, the upper case portion 68 is removable from the lower case portion 66, and thus the upper case can be removed for maintenance purposes, such as, for example, for removing jammed sheet material 60 from the forming members 22, 24.

Sheet material can be initially fed into the dunnage machine 2 by hand without the need for opening the upper case 68. For example, in some embodiments of the present disclosure, the dunnage machine can be primed by hand-crumpling a front section of sheet material 60 and pushing it into the passageway 90', while the forming members 22&24 are activated. When the sheet material 60 reaches the forming members 22, 24, it can be pulled through the dunnage machine 2.

Figure 7:
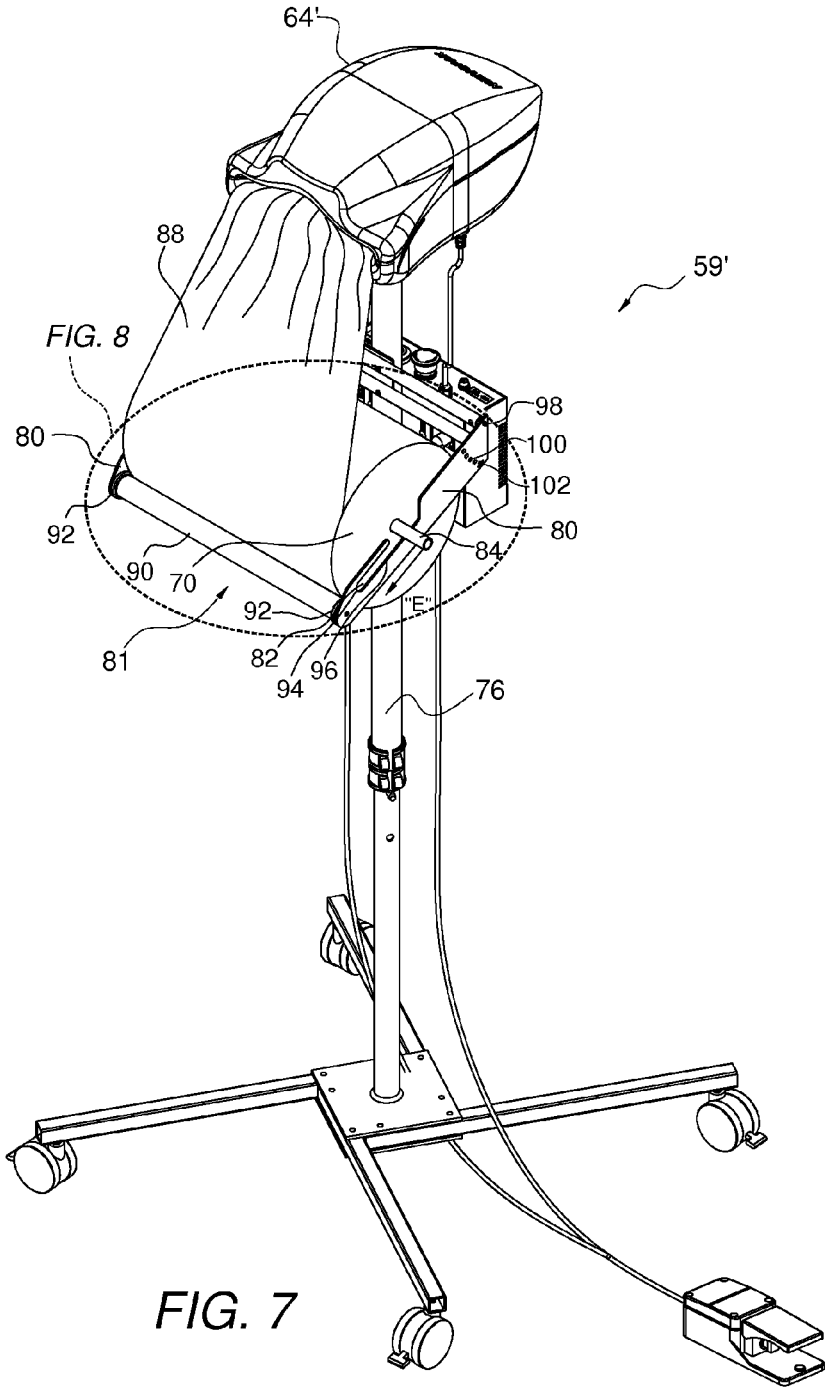
FIG. 7 is a perspective view of an alternative embodiment for the dunnage preparation system of the present disclosure.
Figure 8:
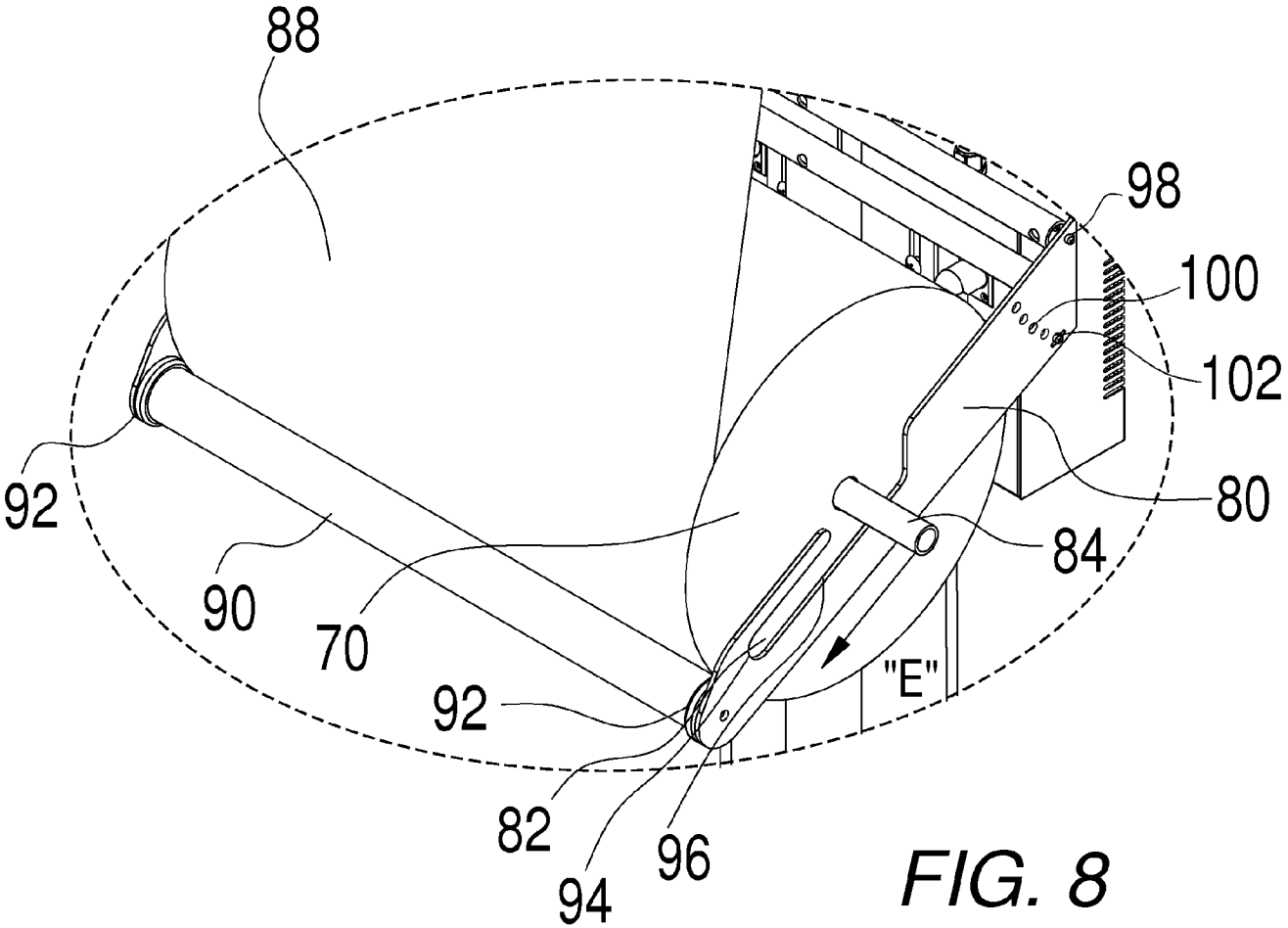
FIG. 8 is a detail perspective view of a portion of the dunnage preparation system shown in FIG. 7.

Referring to FIGS. 7 & 8, in some embodiments of the dunnage system 59' of the present disclosure, a self-adjusting holder 81 is provided for the stock roll 70. The self-adjusting holder 81 can be fixedly coupled to a support rack 76 of the dunnage system 59' and can have a pair of arms 80 that extend outward from the support rack 76 in downwardly slanting fashion. In some embodiments, each arm 80 has a recessed edge-surface 96 with a lower portion of the recessed edge-surface 96 curving to form a hook 82, with an inner hook surface 94.

A cross-bar 90 is provided with each end of the cross-bar being connected to an end portion of one of the arms 80. The cross-bar 90 can be disposed at a lower elevation than an inside surface of the hook 94 on each arm 80. In some embodiments of the present disclosure, the cross-bar is fixedly connected to the arms 80. In other embodiments of the present disclosure, the cross-bar 90 is capable of rotating about a longitudinal axis of the cross-bar 90 without otherwise being displaced with respect to the arms 80. In such embodiments, the cross-bar 90 is rotatably mounted to the end portions of the arms 80.

A stock roll 70 that comprises sheet material wound about a roll-bar 84, as shown in FIG. 8, can be mounted in the self-adjusting holder 81 by placing extended end portions of the roll-bar 84 on the recessed edge-surfaces 96 of the arms 80. In this manner, an outer surface sheet portion 88 of the stock roll 70 can rest directly against the cross-bar 90, as best seen in FIG. 8. As the stock roll 70 is expended, the diameter of the roll will decrease and the roll-bar 84 will be displaced in the direction of arrow "E," until the roll-bar 84 finally rests within the hook 82 against the inner hook-surface 94.

As will be appreciated by those skilled in the art after reviewing this disclosure, when the motor of dunnage machine 2 is stopped, the stock roll 70 momentum can have the tendency to cause the stock roll 70 to continue to rotate on the roll bar 84, despite the fact that the forming members 22, 24 have stopped rotating. This can cause, among other things, bunching of the unwound sheet material. The self-adjusting holder 81 of the present disclosure can help reduce unwinding of sheet material 88 after the motor of the dunnage machine 2 is stopped The contact of the stock roll 70 against the roll-bar 84 can help create resistance to dissipate momentum of the stock roll 70 more quickly when the dunnage machine is stopped. The resistance can be adjusted by adjusting a downwardly sloping angle of the arms 80. That is, the steeper the slope of the recessed edge-surface 96, the more weight of the stock roll 70 will be placed against the cross-bar 90 to increase resistance and dissipate momentum of the stock roll 70.

As such, in some embodiments of the present disclosure, the angle of the self-adjusting holder 81 can be selectively adjusted by a user. As can be seen in FIG. 8, in at least one embodiment, an upper portion of the self-adjusting holder 81 is pivotably attached at point 98 to a section of the support rack 76, and the arms 80 are fixed in place by threading a screw-like member 102 through any one of multiple openings 100 to attach that portion of the arm 80 to a portion of the support rack 76 to select the angle at which the arms 80 rest.

Furthermore, it is noted that since the roll bar 84 of the stock roll 70 rolls into the opening of the hook 82 as the stock roll 70 is expended, the stock roll 70 can be prevented from being lifted off of the recessed edge-surface 96. That is, the stock roll 70 gets lighter in weight as it is expended, but the roll bar 84 rolls into the hook 82 to hold the roll bar 84 from being lifted away.

Figure 9:
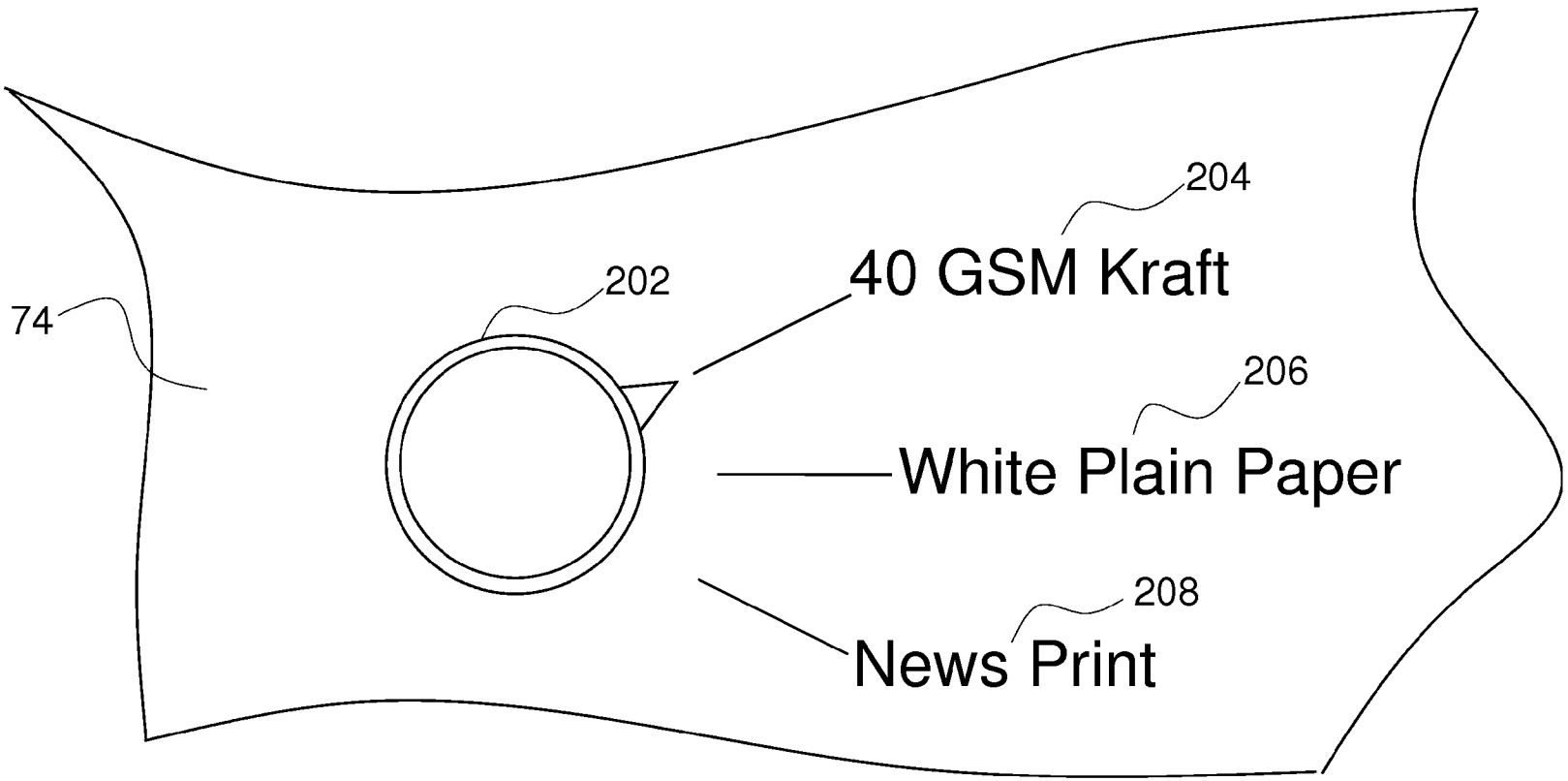
FIG. 9 is a plan view of a paper type selector for some embodiments of the present disclosure.

In some embodiments of the present disclosure, the motor control center 74 can include a speed selector that has selections marked by indicia representing paper types. For example, the paper speed selector 202, or dial, shown in FIG. 9 can be provided remotely, or as part of the motor control center 74 and can have a plurality of speed selections, with each selection being marked with a paper type. The paper types shown in FIG. 9 are 40 GSM Kraft paper, marked by indicia 204, white plain paper marked by indicia 206, and news print paper marked by indicia 208. When the dial 202 is set to indicia 204, the motor speed of the dunnage machine 2 feeds (pulls) paper at a speed of approximately 1.5 meters per second. When the dial 202 is set to indicia 206, the motor speed of the dunnage machine 2 feeds (pulls) paper at a speed of approximately 1.2 meters per second. When the dial 202 is set to indicia 208, the motor speed of the dunnage machine 2 feeds (pulls) paper at a speed of approximately 0.8 meters per second.

The inventors hereof have noted that motor speed can be a substantial factor in determining the actual pulling force on the paper roll. The roll of paper is subjected to larger force with quicker acceleration, and speed can also be a significant factor in preventing paper tearing during processing in the dunnage machine 2. In the embodiments disclosed here for use with the particular motor speeds disclosed above, any effect of acceleration on the paper is dominated by speed selection (with lower speed usually leading to lower acceleration due to the lower input voltage). Furthermore, the inventors hereof have noted that optimization of motor speed has been necessary to limit stress on the paper while fulfilling production needs.

Figure 10:
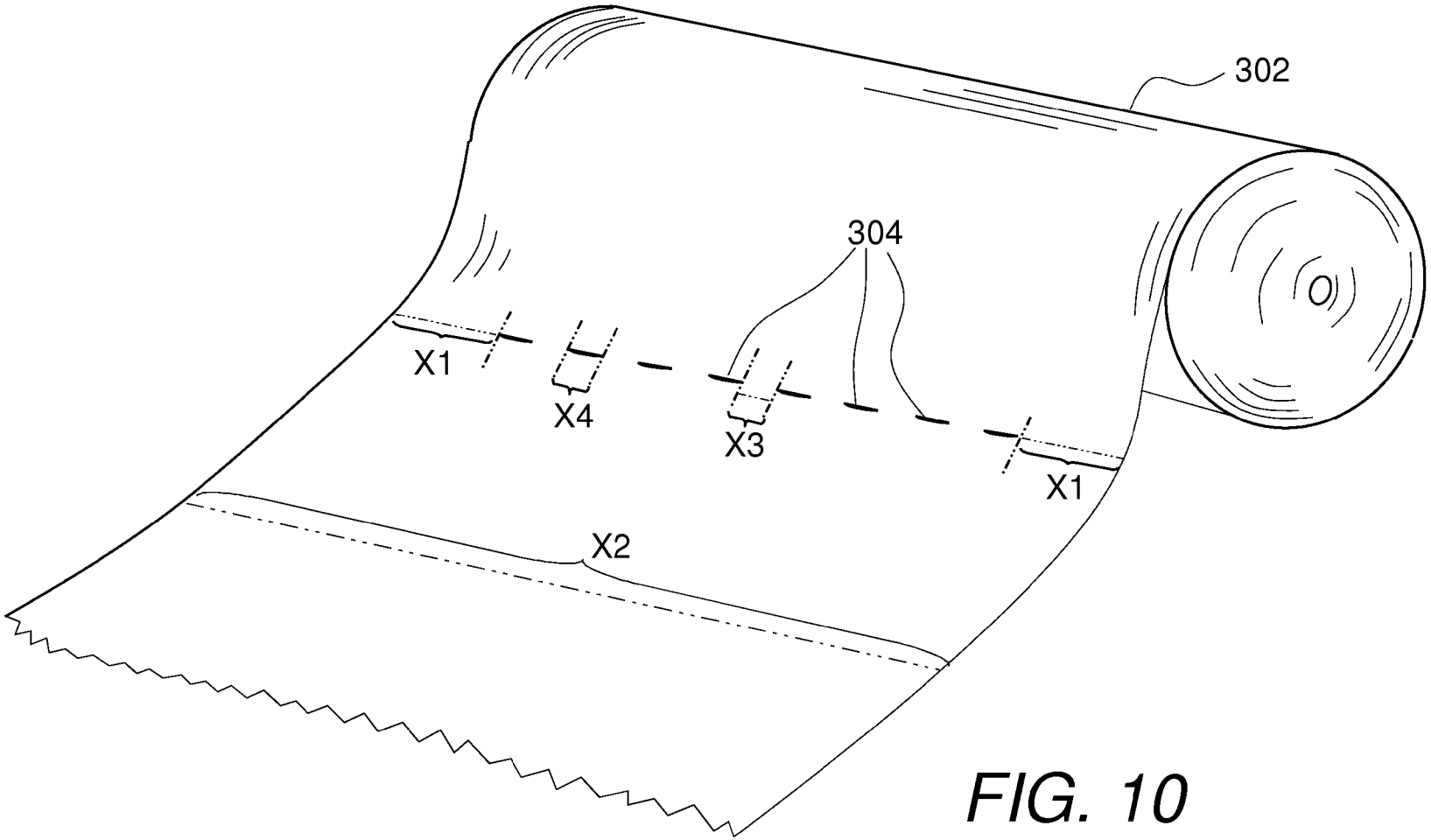
FIG. 10 is a perspective view of a perforated stock paper roll for some embodiments of the present disclosure.

In some embodiments of the present disclosure, perforated stock paper is provided, as illustrated in FIG. 10, as substitute for the stock roll shown in FIG. 6. The provision of perforated stock paper can eliminate the need for use of a cutter in the dunnage machine 2. Perforated paper can be easily "torn" away in sections, without the aid of a cutter from the dunnage machine 2, by a user pulling on the paper at the exit of the dunnage machine 2 to form sections of dunnage. However, perforated paper can be undesirably torn during feeding of the paper in the dunnage machine 2, unless the structure of the perforated paper is optimized. To avoid tearing during feeding, a partially perforated paper roll is disclosed herein.

As shown in FIG. 10, a perforated paper roll 302 made of "kraft" paper, having perforation cuts 304 that stop short of the full width of the paper is provided. For example, the perforated paper roll 302 shown in FIG. 10 is about 380 millimeters wide (labeled as X2 in FIG. 10). The perforations can have edge gaps, or can stop, approximately 10 mm (labeled X1 in FIG. 10) from each of the lateral edges of the paper. Alternatively expressed, about 2.5% of the width of the paper is un-perforated near each edge of the paper. This perforation structure provides increased tensile strength of the paper on the perforated paper roll 302, generally sufficient to avoid tearing while the paper is being fed to the dunnage machine 2 at the motor speed for GSM Kraft paper listed above. The perforated paper roll 302 can have a width of about 15 inches (labeled as X2 in FIG. 10), with a weight of approximately 48.5 GSM, spacing between perforation cuts of about 1 millimeter (labeled as X3 in FIG. 10), and length of perforation cuts being about 3 millimeters (labeled as X4 in FIG. 10). Thus the ratio of perforation cut length to length of space between perforation cuts is about three (3) to one (1). It is also noted that a line of perforation cuts, in accordance with the description above, can be provided across the paper 302 every 250 millimeters along the length of the paper 302 (as measured lengthwise along the perforated paper).

Although specific embodiments and examples of the disclosure have been described supra for illustrative purposes, various equivalent modifications can be made without departing from the spirit and scope of the disclosure, as will be recognized by those skilled in the relevant art after reviewing the present disclosure. The various embodiments described can be combined to provide further embodiments. The described devices, systems and methods can omit some elements or acts, can add other elements or acts, or can combine the elements or execute the acts in a different manner or order than that illustrated, to achieve various advantages of the disclosure. These and other changes can be made to the disclosure in light of the above detailed description.

In general, in the following claims, the terms used should not be construed to limit the claimed inventions to the specific embodiments disclosed in the specification. Accordingly, the inventions are not limited by the disclosure, but instead their scope is determined entirely by the following claims.

What is claimed is:

1. A system for use in producing cushioning material, the system comprising:

a motor;

a plurality of motor driven forming members having fins for use in crumpling sheet material and pulling the sheet material through the machine to form cushioning material, with each of the forming members being rotatable about an axis that is laterally aligned in parallel with a plane of the sheet material being fed to the system;

a passageway having laterally converging sidewalls for compressing the sheet material laterally; and wherein the sheet material is wound in a roll and the roll is held in a holder having a downwardly slanted edge-surface, and wherein as the roll is expended the elevation of an axis of the roll decreases and an outer sheet material portion of the roll abuts against a resting surface that creates resistance against an unwinding of the roll.

2. The system of claim 1, wherein the fins of the forming members have substantially straight outer edges.

3. The system of claim 1 wherein the holder has a hook portion.

4. The system of claim 1 wherein a slope of the downwardly slanted edge-surface is selectively adjustable by a user.

5. The system of claim 1 wherein the resting surface is a rotatable cross-bar.

6. The system of claim 1 wherein the passageway is positioned upstream of the forming members.

7. A system for use in producing a cushioning material, the system comprising:

a motorized section for forming the sheet material into a cushioning material, the motorized section having at least two motor-driven rotatable forming members;

a motor for driving the forming members;

a motor control center for controlling the motor; and a holder for holding a sheet material in a stock roll form, the sheet material being wound in a roll and the roll being held in a holder having a downwardly slanted edge-surface, and wherein a roll bar about which the sheet material is wound rests on the slanted edge-surface.

8. The system of claim 7 further comprising an entrance passageway through which the sheet material is pulled, the passageway having internal sidewalls that converge.

9. The system of claim 7 wherein the slanted edge-surface curves to form a hook-like section.

10. The system of claim 7 wherein a slope of the downwardly slanted edge-surface is selectively adjustable by a user.

* * * * *